US007441975B1

(12) United States Patent
Zigmans et al.

(10) Patent No.: US 7,441,975 B1
(45) Date of Patent: Oct. 28, 2008

(54) DEVICE FOR TREATING A SURFACE, IN PARTICULAR A LEATHER SURFACE, SUCH AS THAT OF LEATHER SHOES

(75) Inventors: Johannes Antonius Gerardus Wilhelmus Zigmans, Rotterdam (NL); Peter Hotchkin, Hilversum (NL); Peter Alphonse Huster, Den Hoorn (NL); Petrus Enricus Aloysius Nicolaas Kuhn, The Hague (NL)

(73) Assignee: Sara Lee / DE N.V. (NL)

( * ) Notice: Subject to any disclaimer, the term of this patent is extended or adjusted under 35 U.S.C. 154(b) by 0 days.

(21) Appl. No.: 09/937,691

(22) PCT Filed: Mar. 24, 2000

(86) PCT No.: PCT/NL00/00198

§ 371 (c)(1),
(2), (4) Date: Feb. 7, 2002

(87) PCT Pub. No.: WO00/57764

PCT Pub. Date: Oct. 5, 2000

(30) Foreign Application Priority Data

Mar. 31, 1999 (NL) ..... 1011711

(51) Int. Cl.
*B43K 5/00* (2006.01)

(52) U.S. Cl. ..... 401/206; 401/264

(58) Field of Classification Search ..... 401/196, 401/205, 206, 263, 264
See application file for complete search history.

(56) References Cited

U.S. PATENT DOCUMENTS

| | | | | |
|---|---|---|---|---|
| 3,135,988 | A * | 6/1964 | Schwartzman | 401/206 |
| 3,410,645 | A | 11/1968 | Schwartzman | |
| 3,661,468 | A | 5/1972 | Schwartzman | |
| 4,035,090 | A | 7/1977 | Bavaveas | |
| 4,993,859 | A | 2/1991 | Assad et al. | |
| 5,568,990 | A | 10/1996 | McAuley | |
| 5,597,255 | A | 1/1997 | Yager et al. | |
| 6,478,497 | B2 * | 11/2002 | Villahoz | 401/206 |

FOREIGN PATENT DOCUMENTS

| | | |
|---|---|---|
| DE | 35 31 661 | 5/1987 |
| EP | 0 271 044 | 6/1988 |
| FR | 2164289 | 4/1974 |
| GB | 2179844 | 3/1987 |

* cited by examiner

*Primary Examiner*—Huyen Le
(74) *Attorney, Agent, or Firm*—Altera Law Group, LLC

(57) ABSTRACT

A device for treating a surface, in particular a textile surface or a leather surface, such as, for instance, the upper surface of leather shoes, with a liquid substance, comprises a holder with a reservoir for this substance and with a sponge-like body via which the substance absorbed from the reservoir can be spread on the surface. Between the reservoir and the sponge-like body there is at least one receiving chamber having an inflow opening communicating with the reservoir. This inflow opening is closed in the condition of rest and can be opened at a movement of the sponge-like body with respect to a plane with which this body is contacted. From the receiving chamber the substance is absorbed by the sponge-like body with delay.

27 Claims, 4 Drawing Sheets

DEVICE FOR TREATING A SURFACE, IN PARTICULAR A LEATHER SURFACE, SUCH AS THAT OF LEATHER SHOES

The present invention relates to a device for treating a surface, in particular a textile surface or a leather surface, such as, for instance, the upper surface of leather shoes, with a liquid substance, which device comprises a holder with a reservoir for this substance and with a sponge-like body via which the substance absorbed from the reservoir can be spread on the surface.

Such a device is known in a form in which it is suitable for polishing and shining shoes. In such a device, the liquid substance is absorbed by the sponge-like body, and when compressing the sponge-like body the substance absorbed is applied to the surface to be treated and spread during movement thereon. The applied amount of liquid substance is undetermined and changes with the degree in which the sponge-like body is compressed each time, which is considered undesirable.

The object of the invention is to remove this drawback at least substantially and to provide a device for treating a surface, in particular a textile surface or a leather surface, such as, for instance, the upper surface of leather shoes, which enables a more regulated outflow of liquid substance.

According to the invention, this object is achieved if the device as defined in the preamble is characterized in that between the reservoir and the sponge-like body there is at least one receiving chamber having an inflow opening communicating with the reservoir, which inflow opening is closed in the condition of rest of the device and can be opened at a movement of the sponge-like body with respect to a plane with which this body is contacted, while from he receiving chamber the substance is absorbed by the sponge-like body with delay.

What can be achieved by this measure is that at or after each operation of the device, that is to say at or after completion of a movement of the sponge-like body with respect to, in particular, a surface to be treated an amount of liquid substance depending on the dimensions of the receiving chamber can be absorbed in the sponge-like body. The dosed amount of liquid substance from a receiving chamber, each time after this chamber has been filled via the inflow opening, has a value ranging between 0.01 and 3 ml, preferably between 0.05 and 1 ml, and which is in particular about 0.1 ml. To enable the filling of the receiving chamber, there is a dosing element extending in the receiving chamber which, at a movement of the sponge-like body with respect to and in contact with a surface to be treated, effects that liquid substance can be absorbed by the sponge-like body.

In a first embodiment, the receiving chamber is bounded by the dosing element and a surface of the sponge-like body and the inflow opening can be released by a tilting movement of the dosing element, in particular as a result of a lateral movement of the sponge-like body over a surface to be treated. The delayed absorption of the substance from the receiving chamber by the sponge-like body is realized by the pores of the sponge-like body. By virtue of the fact that during the filling of the receiving chamber a specific amount of liquid substance is directly absorbed by the sponge-like body, the amount of substance admitted to the receiving chamber after each release of the inflow opening is not determined sufficiently enough, so that an optimum regulation of the substance absorbed by the sponge-like body is not fully obtained after all.

A better regulation of the absorbed amount of liquid substance is obtained in a second embodiment. This is characterized in that the receiving chamber is bounded by the dosing element and the housing of this dosing element and is provided with an outflow opening via which the liquid substance can be supplied to the sponge-like body, the inflow opening being larger than the outflow opening and the inflow opening being releasable by a movement of the sponge-like body with respect to the surface to be treated. The delayed absorption of the substance from the receiving chamber by the sponge-like body is realized in this embodiment by essentially the relatively narrow outflow opening and further possibly by the pores of the sponge-like body.

To ensure that after compression of the sponge-like body the receiving chamber is closed again, the dosing element is movable against spring action in the direction away from the surface to be treated. To allow a proper outflow of the liquid substance from the receiving chamber during the operation of the device, there is an aeration opening which connects the receiving chamber with a space between the receiving chamber and the sponge-like body. This space communicates via the sponge-like body with the atmosphere.

From constructional considerations, it is favorable if the outflow opening is formed by a gap between the housing of the receiving chamber and the dosing element extending therethrough. This gap is preferably annular.

Although one receiving chamber is sufficient, it may be favorable, depending on the size of the surface to be treated, if several, in particular two, receiving chambers are provided. In order that the distance between the outer surface layer of the sponge-like body and the receiving chamber or receiving chambers is kept small, so that the liquid substance absorbed by the sponge-like body arrives at the outer surface layer relatively fast, the receiving chamber or receiving chambers is/are, on the one hand, at least partly arranged in the sponge-like body, while, on the other hand, the thickness, density and structure of the sponge-like body is such that between the outflow of the substance from the receiving chamber and the arrival of the liquid substance at the outer surface layer of the sponge-like body there is a time delay corresponding to at least the time between two, preferably at least six, successive times the device is operated. When moving the sponge-like body, the outer layer of the liquid substance already earlier absorbed by the sponge-like body is applied to the surface to be treated, while a new defined amount of liquid substance can be supplied to the sponge-like body and be absorbed therein with delay. When the device according to the invention is used, an amount of liquid substance can thus always be applied from the sponge-like body to the surface to be treated which approximately corresponds to the amount absorbed with delay by the sponge-like body from the receiving chamber. Consequently, the supply of liquid substance to the surface to be treated is very uniform and remains practically constant until the reservoir is entirely empty. To ensure that the above time delay does not have the result that the device cannot be properly used immediately on purchase and that, therefore, already at the first few times sufficient liquid substances is applied by the device to the surface to be treated, the sponge-like body, before the device is put into use, is impregnated, preferably in the outer surface layer, with a substance, the composition of which, as will be further explained below, need otherwise not be exactly the same as that in the reservoir.

To make it visible whether and/or in what extent the reservoir is still filled, the holder or at least part of the holder and preferably the reservoir or a part thereof are made of a transparent material. Arranged in a part, preferably in an upper part, it forms a window. Should the liquid substance, for instance for reasons to be mentioned below, be used in different specific colors, then the device with the desired color can also be recognized through the transparent holder or through this window.

Although the selection of such a transparent material or such a window is particularly suitable for the invention as hitherto described, the application thereof is wider. The invention therefore also relates to a device for treating a surface, in particular a textile surface or a leather surface, such as, for instance, the upper surface of leather shoes, with a liquid substance, which device comprises a holder with a reservoir for this substance and with a sponge-like body via which the substance absorbed from the reservoir can be spread on the surface, which device is characterized in that the holder or at least part of the holder and preferably the reservoir or a part thereof is made of a transparent material or is provided with a window. In this connection it holds that in particular between the reservoir and the sponge-like body there is at least one receiving chamber with an inflow opening communicating with the reservoir, which inflow opening is closed in the condition of rest of the device and can be opened at a movement of the sponge-like body with respect to a surface with which this body is contacted, while from the receiving chamber the substance is absorbed by the sponge-like body with delay.

To prevent the liquid substance from being subjected to an unduly high resistance on its way from the reservoir to the sponge-like body and from nevertheless being easily applicable from the sponge-like body at a movement of the sponge-like body with respect to a surface to be treated, the viscosity of the substance is, on the one hand, sufficiently low so that the substance can pass the inflow opening and is, on the other hand, sufficiently high so that the substance does not leak from he sponge-like body when no force is exerted thereon. Preferably, the viscosity of the substance ranges between 1,000 and 20,000 $mm^2sec^{-1}$, in particular between 5,000 and 12,000 $mm^2sec^{-1}$. Since the problem may occur that at a specifically desired composition of the liquid substance a suitably selected viscosity is not possible very well, it is favorable if after the outflow from the receiving chamber the substance is subjected to a change of viscosity. In particular if the substance contains an active component having a relatively high viscosity, preferably greater than 5,000 $mm^2sec^{-1}$, in particular greater than 10,000 $mm^2sec^{-1}$, and an auxiliary component having a relatively low viscosity, preferably less than 5,000 $mm^2sec^{-1}$, in particular less than 2,000 $mm^2sec^{-1}$, it becomes possible that through evaporation of the auxiliary component in the sponge-like body the viscosity of the substance therein increases such that a leakage from the sponge-like body is prevented, while, nevertheless, the viscosity of the substance in the reservoir is sufficiently low to readily pass the receiving chamber. A resistance in the sponge-like body to prevent leakage of substance therefrom may otherwise also be realized by reducing the pores of the sponge-like body; this, however, does not contribute to the operation of the device according to the invention.

The above active component may serve to shine, protect, make more durable, smoothen, color the surface to be treated, etc. In a specific use for the treatment of a leather surface, such as, for instance, the upper surface of leather shoes, the substance in the reservoir comprises at least one first component imparting a shine to the leather as well as at least one second component processing properties for spreading the substance over the leather surface. Such a substance can indeed be favorably used in the device according to the invention as hitherto described, but it also has a wider applicability. Consequently, the invention also relates to a device for treating a surface, in particular a leather substance, such as, for instance, the upper surface of leather shoes, with a liquid substance, which device comprises a holder with a reservoir for this substance and with a sponge-like body via which the substance absorbed from the reservoir, can be spread on the surface, which device is characterized in that the substance comprises at least one first component imparting a shine to the leather as well as at least one second component possessing properties for spreading the substance over the leather surface.

In a concrete embodiment, the first component consists of a polydimethyl silicone having a relatively high viscosity, preferably greater than 5,000 $mm^2sec^{-1}$, in particular greater than 10,000 $mm^2sec^{-1}$, and the second component consists of polydimethyl silicone, which may or may not be aminofunctional, having a relatively low viscosity, preferably less than 5,000 $mm^2sec^{-1}$, in particular less than 2,000 $mm^2sec^{-1}$. It appears that through the combination of these two components a great shine equality and durability can be obtained. As third component, a non-reactive aminofunctional polydimethyl silicone may be added to the substance. In particular aminofunctional polydimethyl silicone further contributes to the adhesion of the substance to the leather. It therefore appears that through this addition a great shine equality and durability can be obtained. In this use, the viscosity of the substance in the reservoir will reside in the interval of 500-9,000 $mm^2sec^{-1}$. The viscosity is not allowed to be so high that the liquid substance is applied in an unduly thick layer; similarly, the viscosity is also not allowed to be so low that the desired shine of the leather cannot be obtained. The selection of the viscosity is further adjusted to an easy transport of the substance from the reservoir to and through the sponge-like body.

To provide the surface to be treated with a coloring, a pigment can be used. For this reason, according to a further aspect of the invention, a pigment, in particular a water-dispersible pigment, is provided in the sponge-like body, preferably at the bottom of the space in the sponge-like body where a receiving chamber is situated, or in a receiving chamber itself. It has been found that this pigment, in particular the water-dispersible pigment, can be sufficiently transported through the liquid oily substance from the reservoir to the outer surface layer of the sponge-like body. Through this addition, simultaneously with the application of a shine, a coloring can be applied to the surface to be treated.

The pigment can be dispersed in the substance contained in the reservoir. Thus a pigment dispersed in a polar solvent, such as an alcohol or an ether, in particular a glycol ether, may be added to the substance in the reservoir. It is also possible to add a pigment dispersed in a non-polar solvent, such as white spirits, to the substance in the reservoir.

To indicate which color is applied to the surface to be treated by and/or with the aid of a substance in the reservoir, a color representative of the color of the pigment may be added to the substance in the reservoir. Thus a coloring agent dissolved in the above polar or non-polar solvents may be added to the substance in the reservoir.

The invention will now be explained in more detail with reference to the accompanying drawing, in which.

Figure 2:
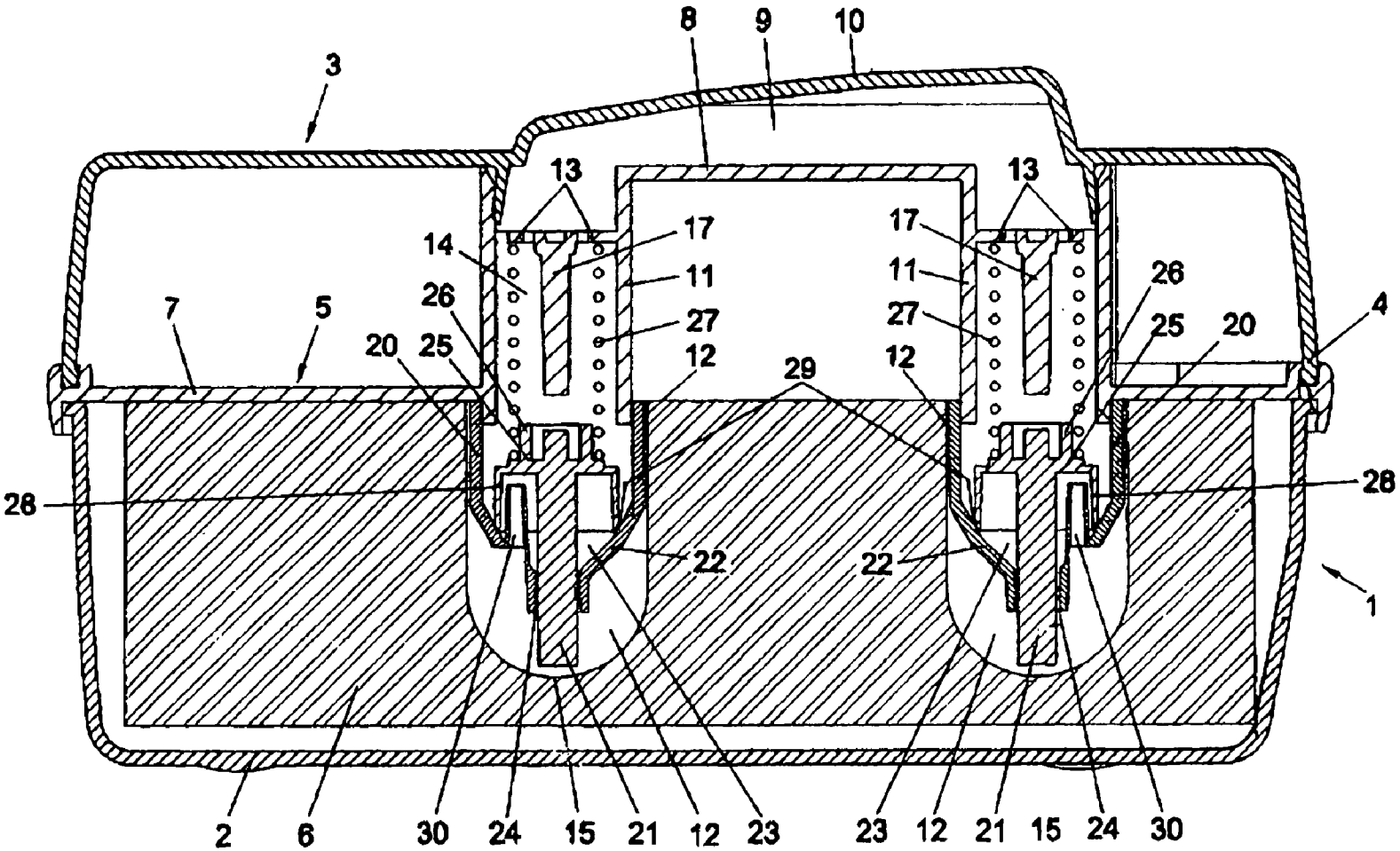
FIG. 2 shows a second embodiment of such a device.
Figures 3A, 3B, 3C:
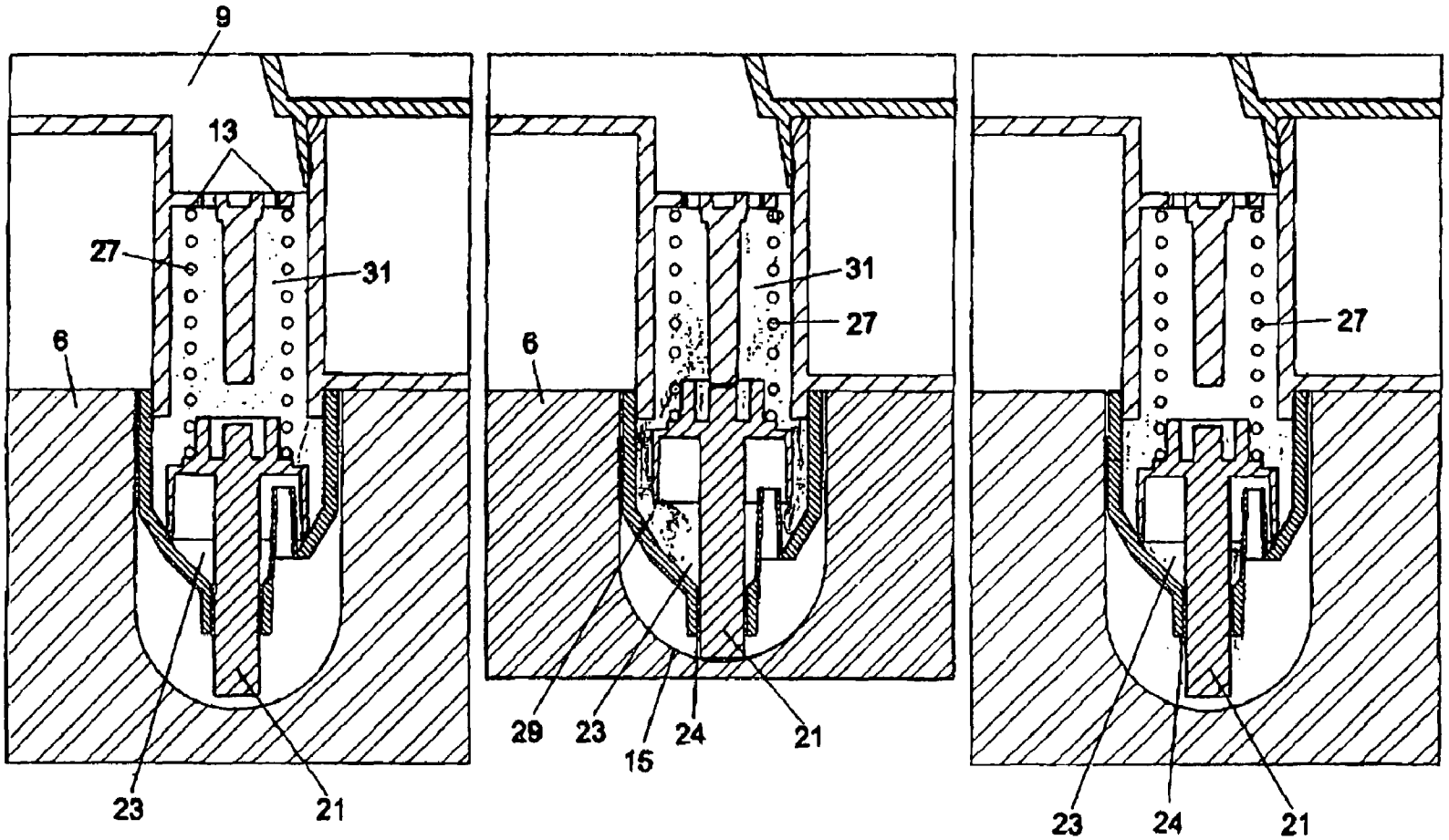
Figure 4:
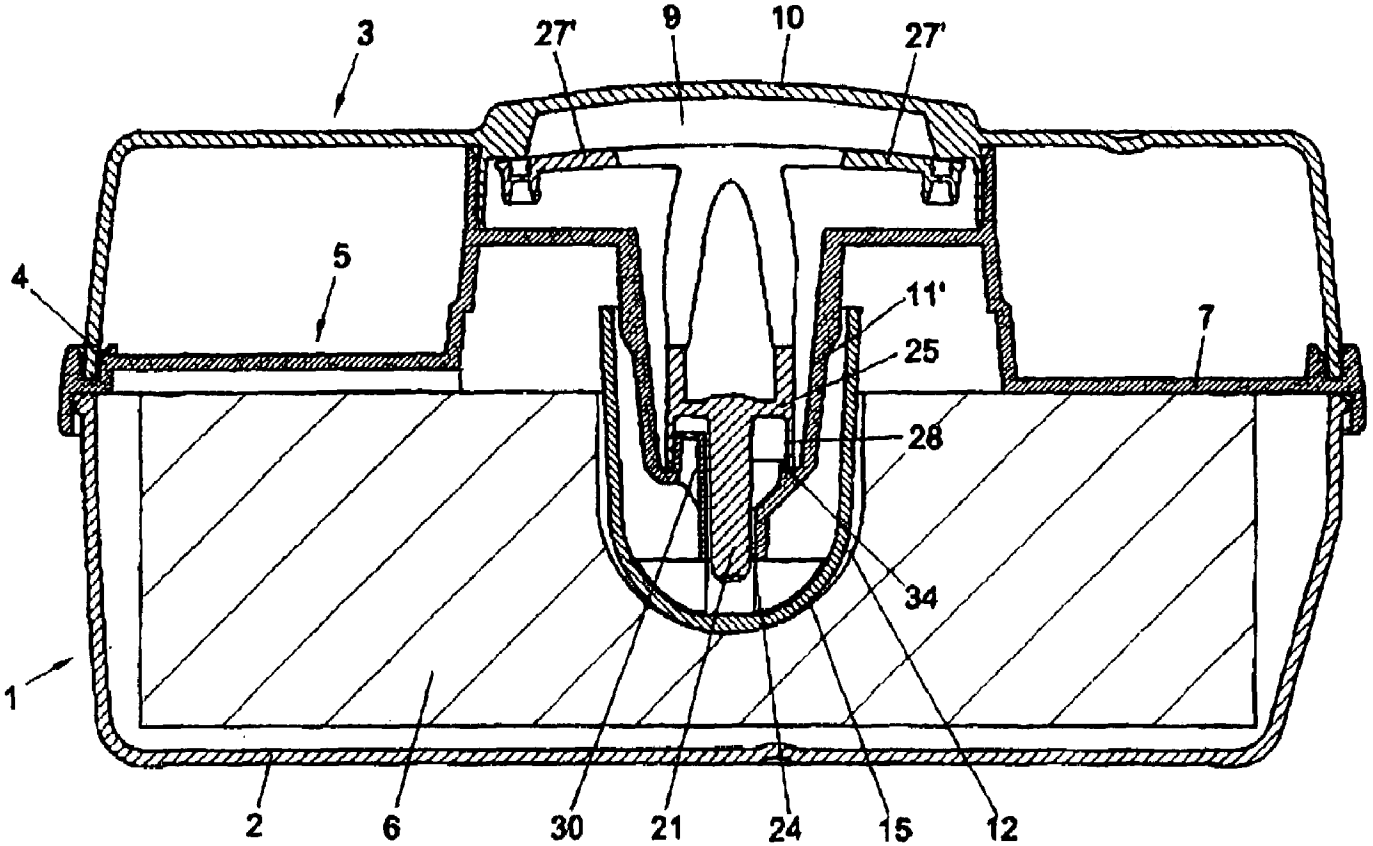

FIGS. 3A, 3B, and 3C show a part of the device in FIG. 2 during successive steps in the use of this device; and FIG. 4 shows a third embodiment of the device according to the invention.

In the figures corresponding parts are indicated by equal reference numerals.

Figure 1:
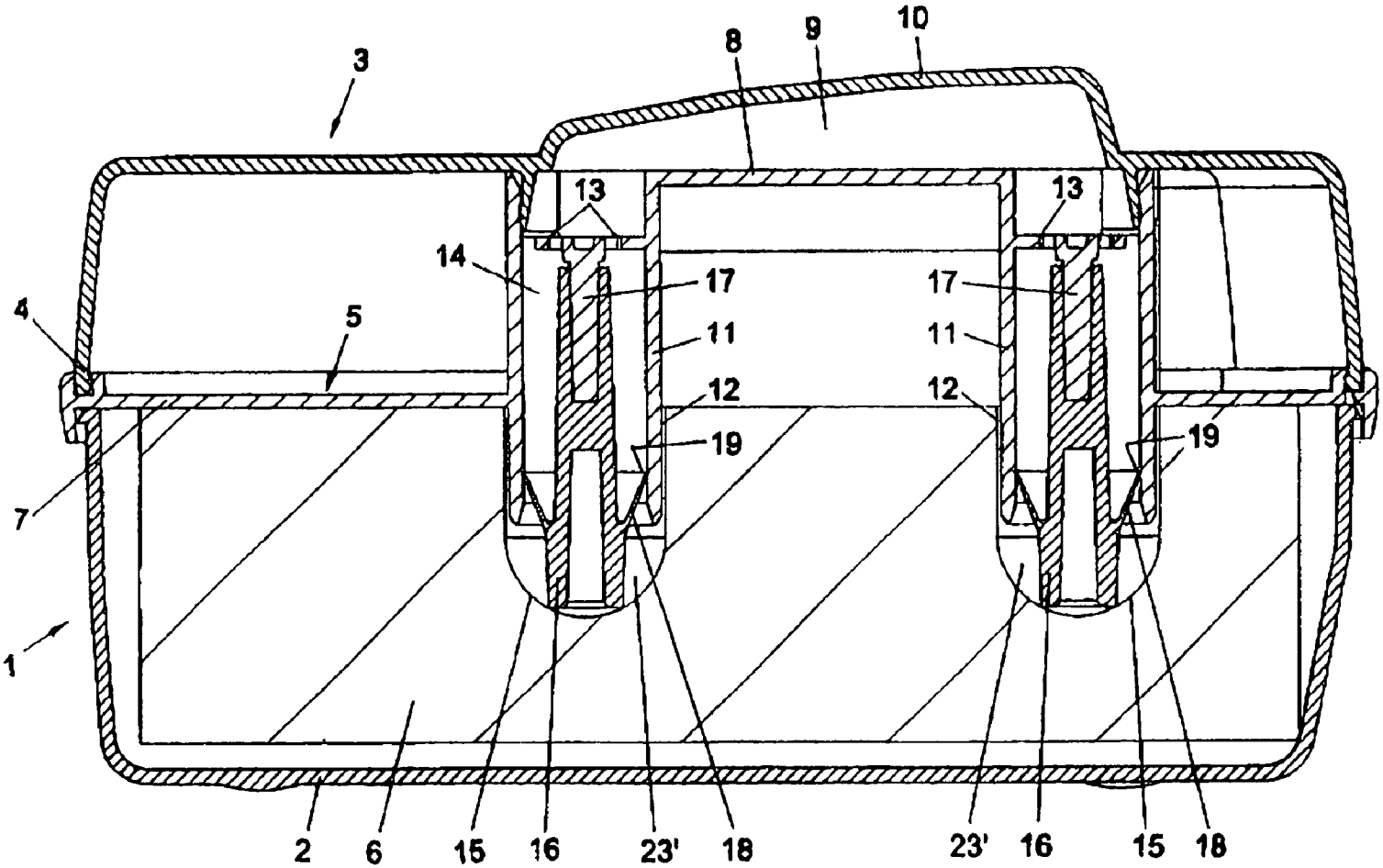
FIG. 1 shows a first embodiment of a device according to the invention.

The device according to the invention, as shown in FIG. 1, comprises a holder 1 built up of a lower box-shaped part 2 and an upper cover-shaped part 3. The two parts 2 and 3 are of rectangular shape. The lower edge 4 of the cover-shaped part 3 is closed with a supporting element 5. Arranged at the lower side of this supporting element 5 is a sponge-like body 6. The cover-shaped part 3 with the supporting element 5 and the sponge-like body 6 form one whole which fits on and into the box-shaped part 2, the sponge-like body 6 being located in the box-shaped part when he cover-shaped part is placed and clamped on the box-shaped part. When the device according to the invention is put into use, this whole of cover-shaped part, supporting element and sponge-like body is removed from the box-shaped part.

The supporting element 5 has a lower annular part 7, to which the sponge-like body is fixed, in particular glued, as well as a higher part 8, by which a reservoir 9 for a liquid substance is bounded. The upper side of this reservoir is formed by an upwardly protruding part 10 of the cover-shaped part 3. This upwardly protruding part 10 forms a window of a transparent material, so that from the upper side of the device it can be established whether the reservoir 9 is still filled with liquid substance. Furthermore, the supporting element 5 comprises two hollow cylindrical parts 11 which extend vertically from the reservoir 9 into openings 12 of a hollow space in the sponge-like body 6. The reservoir 9 communicates via openings 13 with a space 14 in the cylindrical parts 11; furthermore, the reservoir is completely closed by the supporting element 5. The space 14 in the cylindrical parts 11 is the entrance to a receiving chamber 23' for the liquid substance from the space 14. The receiving chamber 23' is formed by the lower part of the hollow space in the sponge-like body 6.

The hollow spaces in the sponge-like body 6 have the form of a cylindrical bore with a spherical lower end 15. In such a bore a dosing element 16 extends to practically against the lower end 15. The dosing element 16 is fixed at the upper side to a projecting part 17 of the supporting element 5 between the openings 13. More downwardly, the dosing element 16 is provided with a closing element 18 in the form of a frusto-conical surface which, in the condition of rest, abuts against the inner side of a relevant hollow cylindrical part 11 and an inflow opening 19 to the receiving chamber 23' provided thereunder. The dosing element 16 yields somewhat, namely in the sense that the dosing element 16 can be moved around back and forth in the lateral direction. Such a movement can be realized by moving the sponge-like body 6 back and forth with the lower face against a contact face; as a result of the deformation thus occurring in the sponge-like body 6 the lower ends 15 of the bores are moved back and forth and with them the dosing elements 16. At such a back-and-forth movement the inflow opening 19 is released at one side, and the contents of the space 14 can flow into the receiving chamber 23' at the bottom of the bore and then be absorbed by the sponge-like body 6 with a certain delay.

By previously bringing a specific amount of liquid substance into the sponge-like body 6, it is possible already at the first time or the first times the device is used to directly apply a layer of liquid substance to a surface to be treated by moving the sponge-like body back and forth over this surface while exerting a certain pressure. By doing so, the liquid substance is pressed out of the sponge-like body, after which, as soon as the pressure falls out or the device is no longer used, the liquid substance collected in the receiving chamber 23' during the back-and-forth movement of the sponge-like body is absorbed by the sponge-like body. Thus a very uniform distribution of liquid substance in the sponge-like body is continuously obtained with a certain delay, until the reservoir 9 is empty at last. Now the thickness, density and structure of the sponge-like body are such that between the outflow of the liquid substance via the inflow opening 19 and the arrival of this substance at the outer surface layer of the sponge-like body 6 there is a time delay corresponding to at least the time between two and preferably at least six, successive times the device is used. This ensures that, even if the reservoir is just like empty, the device can be used a few more times, until practically all the substance in the sponge-like body has been consumed. A small amount will always be left in the sponge-like body.

The preferred embodiment in FIGS. 2 and 3A-C differs from the embodiment in FIG. 1 by the design and manner of functioning of the receiving chamber and the dosing element. The cylindrical parts 11 extend less far into the relevant bores in the sponge-like body 6, but are provided at the lower side with a sleeve-shaped part 20 which is approximately conical in a downward direction and ends in a construction through which a dosing element 21 extends to near the lower end 15 of a bore. Here the conical part 22 of a sleeve-shaped part 20 forms a boundary of the receiving chamber 23, the outflow opening 24 of which in the form of an annular gap forms a permanent connection between a relevant receiving chamber 23 and a space at the bottom of the bore in the sponge-like body 6. Here, too, the receiving chamber 23 is completely located within the sponge-like body 6. The dosing element 21 is provided at the upper side with a broadening 25 having thereon a cylindrical engaging element 26 for a spring 27 which is active between the supporting element 5, namely in the part thereof around the openings 13, and the dosing element 21. At the lower side of the broadening 25 there is a shell-shaped element 28 which is open at the lower side. The shell-shaped element 28 and the broadening 25 form the upper boundary of the receiving chamber 23. In the condition of rest, the spring 27 keeps the dosing element 21 in the lowermost position, which is the position in which the shell-shaped element 28 rests against the conical part 22 and the inflow opening 29 of the receiving chamber 23 between the shell-shaped element 28 and the conical part 22 is closed. Arranged in the conical part 22 is a circle segment-shaped aeration opening 30 which communicates the receiving chamber 23 with the space at the bottom of the relevant bore in the sponge-like body 6.

The operation of the device shown in FIG. 2 will be explained with reference to FIGS. 3A-C. These figures show the dosing mechanism for only one opening in the sponge-like body 6. FIG. 3A shows the condition of rest in which the spring 27 keeps the dosing element 21 in its lowermost position and the receiving chamber 23 is empty and closed at the upper side. Via the openings 13 the space 31 above the dosing element 21 is filled with the liquid substance from the reservoir 9. FIG. 3B shows the sponge-like body 6 in the position in which it is compressed on a surface to be treated. By such a compression, the dosing element 21 in contact with the lower end 15 of the bore in the sponge-like body 6 is moved upwards against the action of the spring 27 and the inflow opening 29 of the receiving chamber 23 is released so that this chamber is filled with the liquid substance from the space 31. As soon as the pressure on the sponge-like body 6 is removed, the dosing element 21 will move downwards under the action of the spring 27 and the receiving chamber 23 is closed again at the upper side. This situation is shown in FIG. 3C. As mentioned before, the receiving chamber 23 is, via the gap 24, in a permanent open communication with the space at the bottom of the bore in the sponge-like body 6. By virtue of the fact that the inflow opening 29 of the receiving chamber 23 is much larger than the outflow opening 24 (see FIG. 3B), the receiving chamber is filled very fast and practically no liquid substance has been able to creep away through the outflow opening 24. In the subsequent time when the device is not in use, the defined amount of liquid substance in the receiving chamber 23 can be absorbed by the sponge-like body 6 via the outflow opening 24 and the space at the bottom of the bore. By virtue of the fact that each time a defined amount is absorbed by the sponge-like body, there is obtained, when compared to the embodiment of FIG. 1, a better regulation of the liquid substance stream through the sponge-like body. The further manner in which the device shown in FIGS. 2 and 3A-C operates is equal to that of the embodiment shown in FIG. 1.

The dimensioning of the receiving chamber 23 and the dimensions of the inflow and outflow opening 29 and 24, respectively, as well as the thickness, density and structure of the sponge-like body 6 must be adjusted to the viscosity of the liquid substance. The concrete design of the device according to the invention therefore strongly depends on the use, that is to say the result to be obtained with the liquid substance.

The embodiment shown in FIG. 4 substantially corresponds to the embodiment shown in FIG. 2. But here there is only one receiving chamber 23 between the reservoir 9 and the sponge-like body 6. Instead of cylindrical parts 11, slightly tapered parts 11' are provided, while the space 9 is integral with the space 14 in the slightly tapered parts 11'. The lower end of the parts 11' has a shape equal to the a sleeve-shaped part 20 in FIG. 2, with the understanding that a sealing lip 34 is provided to prevent, in the condition of rest, liquid substance from leaking from the space 14 to the receiving chamber 23. Furthermore, the spring 27, the associated point of engagement 26 and the point of abutment on the supporting element 5 are replaced by a leaf spring construction, leaf springs 27' being attached at one end to the dosing element 21 and at the other end to the cover-shaped part 3. In the opening 12 there is further arranged a protective element 32 ending at the lower side in a plurality of converging lips 33. The operation of this embodiment is otherwise the same as that of the embodiment shown in FIG. 2.

The embodiments shown are adjusted to a liquid substance with which a shiny effect on leather can be obtained, for instance for polishing shoes. To this end, the liquid substance which can be applied to the upper side of leather shoes by means of the device according to the invention comprises a first component first component imparting a shine to the leather and a second component possessing properties for spreading the liquid substance over the leather. The first component consists of a polydimethyl silicone having a viscosity greater than 10,000 $mm^2sec^{-1}$, and the second component consists of a more volatile polydimethyl silicone, the viscosity of which is less than 2,000 $mm^2sec^{-1}$. To obtain a better adhesion, a non-reactive aminofunctional polydimethyl silicone is added to the substance. In connection with the dimensioning and design of the device, the viscosity of the substance, that is to say of the mixing product, resides in the interval of 500-9,000 $mm^2sec^{-1}$. To simultaneously apply a coloring to the leather, a water-dispersible pigment is brought at the bottom of the hollow spaces in the sponge-like body 6. When using the device according to the invention, this pigment is transported by the substance from the reservoir 9, that is to say by an oil transport medium, to the outer surface layer of the sponge-like body 6. This measure is taken in combination with the dispersion of the pigment in the substance contained in the reservoir. Instead thereof, it is of course also possible to add the pigment dispersed in a polar solvent, such as an alcohol or an ether, in particular a glycol ether, or dispersed in a non-polar solvent, such as white spirits, to the substance in the reservoir. Furthermore, to indicate the pigment color, a coloring agent brought into a suitable solvent is added to the substance in the reservoir. A further alternative, although less efficient, consists in that a pigment dispersed in silicon oil—without a volatile component and with a viscosity of approximately 10,000 to 15,000 $mm^2sec^{-1}$—is impregnated in the outer layer, that is to say in the figures in the lowermost layer of the sponge-like body, namely with the aid of a roller mechanism. The oil will then contain approximately 1 to 5% pigment; too much pigment decreases the shine to be obtained.

The invention is not limited to the embodiments described herein with reference to the drawing; it comprises all kinds of modifications, both in the structure of the device and in the composition of the liquid substance, of course as far as they fall within the scope of protection of the annexed claims.

The invention claimed is:

1. A device for treating a surface with a liquid substance, which device comprises:

a holder with a reservoir for substance, a sponge-like body via which the substance absorbed from the reservoir can be spread on the surface, at least one receiving chamber located between the reservoir and the sponge-like body having an inflow opening communicating with the reservoir and an outflow opening for supplying the liquid substance to the sponge-like body, the inflow opening being closed in the condition of rest of the device and being releasable by a movement of the sponge-like body with respect to the surface to be treated, whereas the receiving chamber is in a permanent open communication with the sponge like body via the outflow opening, characterized in that the inflow opening is larger than the outflow opening so as to cause the liquid substance flowing into the receiving chamber through the inflow opening fills the receiving chamber very quickly and substantially no liquid substance creeps away through the outflow opening, the liquid substance being thus absorbed by the sponge-like body with a certain time delay in that the receiving chamber is aerated by an aeration opening connecting the receiving chamber with a space between the receiving chamber and the sponge-like body for allowing a proper outflow of the liquid substance from the receiving chamber during the operation of the device.

2. A device according to claim 1, characterized in that the dosed amount of liquid substance from a receiving chamber, each time after it has been filled via the inflow opening, has a value ranging between 0.01 and 3 ml, preferably between 0.05 and 1 ml, and which is in particular about 0.1 ml.

3. A device according to claim 1, characterized in that there is a dosing element extending in the receiving chamber which, at a movement of the sponge-like body with respect to and in contact with the surface to be treated, effects that liquid substance can be absorbed by the sponge-like body.

4. A device according to claim 1, characterized in that the receiving chamber is bounded by the dosing element and a surface of the sponge-like body, and the inflow opening can be released by a tilting movement of the dosing element, in particular as a result of a lateral movement of the sponge-like body over the surface to be treated.

5. A device according to claim 1, characterized in that the receiving chamber is bounded by the dosing element and a housing of this dosing element and is provided with an outflow opening via which the liquid substance can be supplied to the sponge-like body, the inflow opening being larger than the outflow opening, and the inflow opening being releasable by a movement of the sponge-like body with respect to the surface to be treated.

6. A device according to claim 5, characterized in that the inflow opening is released by moving the dosing element away from the surface to be treated, in particular as a result of the compression of the sponge-like body on the surface to be treated.

7. A device according to claim 6, characterized in that the dosing element is movable against spring action in the direction away from the surface to be treated.

8. A device according to claim 5, characterized in that there is an aeration opening which connects the receiving chamber with a space between the receiving chamber and the sponge-like body.

9. A device according to claim 5, characterized in that the outflow opening is formed by a gap between the housing of the receiving chamber and the dosing element extending therethrough.

10. A device according to claim 9, characterized in that the gap is annular.

11. A device according to claim 1, characterized in that there are several, in particular two, receiving chambers.

12. A device according to claim 11, characterized in that the receiving chamber or receiving chambers is/are at least partly arranged in the sponge-like body.

13. A device according to claim 1, characterized in that the thickness, density and structure of the sponge-like body is such that between the outflow of the substance from the outflow opening and the arrival of the substance at the outer surface layer of the sponge-like body there is a time delay corresponding to at least the time between two, preferably at least six, successive times the device is operated.

14. A device according to claim 13, characterized in that the sponge-like body, before the device is put into use, is impregnated with a liquid substance.

15. A device according to claim 1, characterized in that the holder or at least part of the holder and preferably the reservoir or a part thereof is made of a transparent material or is provided with a window.

16. A device according to claim 1, characterized in that the viscosity of the substance is, on the one hand, sufficiently low so that the substance can pass the inflow opening and is, on the other hand, sufficiently high so that the substance does not leak from the sponge-like body when no force is exerted thereon.

17. A device according to claim 16, characterized in that after the outflow from the receiving chamber the substance is subjected to a change of viscosity.

18. A device according to claim 16, characterized in that the viscosity of the substance ranges between 500 and 20,000 $mm^2sec^1$, in particular between 500 and 9,000 $mm^2sec^1$.

19. A device according to claim 16, characterized in that the substance contains an active component having a relatively high viscosity, preferably greater than 5,000 $mm^2sec^1$, in particular greater than 10,000 $mm^2sec^1$, and an auxiliary component having a relatively low viscosity, preferably less than 5,000 $mm^2sec^1$, in particular less than 2,000 $mm^2sec^1$.

20. A device according to claim 16, characterized in that the substance in the reservoir for treating a leather surface, such as, for instance, the upper surface of leather shoes, comprises at least one first component imparting a shine to the leather as well as at least one second component possessing properties for spreading the substance over the leather surface.

21. A device according to claim 20, characterized in that the first component consists of a polydimethyl silicone having a relatively high viscosity, preferably greater than 5,000 $mm^2sec^1$, in particular greater than 10,000 $mm^2sec^1$, and the second component consists of polydimethyl silicone, which may or may not be aminofunctional, having a relatively low viscosity, preferably less than 5,000 $mm^2sec^1$, in particular less than 2,000 $mm^2sec^1$.

22. A device according to claim 21, characterized in that as third component a non-reactive aminofunctional polydimethyl silicon is added to the substance.

23. A device according to claim 20, characterized in that a pigment, in particular a water-dispersible pigment, is provided in the sponge-like body, at the bottom of the space in the sponge-like body where a receiving chamber is located, or in a receiving chamber itself.

24. A device according to claim 23, characterized in that the pigment is transported by the substance from the reservoir to the outer surface layer of the sponge-like body.

25. A device according to claim 20, characterized in that the pigment is dispersed in the substance contained in the reservoir.

26. A device according to claim 20, characterized in that a pigment dispersed in a polar solvent, such as an alcohol or an ether, in particular a glycol ether, or a coloring agent dissolved therein is added to the substance in the reservoir.

27. A device according to claim 20, characterized in that a pigment dispersed in a non-polar solvent, such as white spirits, or a coloring agent dissolved therein is added to the substance in the reservoir.

* * * * *